US006830370B1

(12) United States Patent
Uematsu

(10) Patent No.: US 6,830,370 B1
(45) Date of Patent: Dec. 14, 2004

(54) CAVITATION GENERATING DEVICE AND FLUID MIXING DEVICE USING THE DEVICE

(75) Inventor: Hideto Uematsu, Iruma (JP)

(73) Assignee: Ohr Co., Ltd., Iruma (JP)

( * ) Notice: Subject to any disclaimer, the term of this patent is extended or adjusted under 35 U.S.C. 154(b) by 5 days.

(21) Appl. No.: 10/416,512

(22) PCT Filed: Nov. 28, 2000

(86) PCT No.: PCT/JP00/08364

§ 371 (c)(1),
(2), (4) Date: May 22, 2003

(87) PCT Pub. No.: WO02/43846

PCT Pub. Date: Jun. 6, 2002

(51) Int. Cl.[7] ..... B01F 5/06
(52) U.S. Cl. ..... 366/337
(58) Field of Search ..... 366/336, 337

(56) References Cited

U.S. PATENT DOCUMENTS

| | | | | | |
|---|---|---|---|---|---|
| 3,643,927 | A | * | 2/1972 | Crouch | 366/337 |
| 3,652,061 | A | * | 3/1972 | Chisholm | 366/337 |
| 4,270,576 | A | * | 6/1981 | Takeda et al. | 366/337 |
| 4,487,510 | A | * | 12/1984 | Buurman et al. | 366/337 |
| 4,511,258 | A | * | 4/1985 | Federighi et al. | 366/337 |
| 4,643,584 | A | * | 2/1987 | Allocca | 366/337 |
| 4,758,098 | A | * | 7/1988 | Meyer | 366/337 |
| 4,936,689 | A | * | 6/1990 | Federighi et al. | 366/337 |
| 5,492,499 | A | * | 2/1996 | Van Haren et al. | 366/337 |
| 5,520,460 | A | * | 5/1996 | Lantz | 366/337 |
| 5,813,762 | A | * | 9/1998 | Fleischli et al. | 366/337 |

FOREIGN PATENT DOCUMENTS

| | | |
|---|---|---|
| JP | 54-105972 | 7/1979 |
| JP | 58-46343 | 10/1983 |
| JP | 62-269733 | 11/1987 |
| JP | 7-124577 | 5/1995 |
| JP | 7-63597 | 7/1995 |
| JP | 9-150044 | 6/1997 |

* cited by examiner

*Primary Examiner*—Tony G. Soohoo
(74) *Attorney, Agent, or Firm*—Westerman, Hattori, Daniels & Adrian, LLP

(57) ABSTRACT

A cavitation generating device, wherein the chordal side edges of a pair of semi-elliptic vane panel disposed in a pipe body allowing fluid to be force-fed are crossed aslant with each other, a space between code side edges on the upstream side of the crossed part is closed by a partition plate dividing a pipe body cross-section into two parts, an opening part formed between a chordal edge of one semi-elliptic vane panel on the downstream side of the crossed part and a chordal edge of the other semi-elliptic vane panel on the upstream side of the crossed part is closed partially by restricting means such as a baffle board so as to form a guide vane, and an arc side edge of the semi-elliptic vane panel of the guide vane is connected to the inner wall of a fluid force-feeding pipe body; a fluid mixing device, wherein a plurality of projections are projected radially from the inner peripheral board surface of the pipe body on the downstream side of the guide vane.

3 Claims, 11 Drawing Sheets

CAVITATION GENERATING DEVICE AND FLUID MIXING DEVICE USING THE DEVICE

TECHNICAL FIELD

The present invention concerns an improvement for a cavitation (cavitation phenomenon) generating device for generating a local negative pressure to a fluid passing through a pipe body and a fluid mixing device using the device described above.

BACKGROUND ART

As a preceding step of intensifying mixing and stirring of a fluid for promoting various types of reactions, it has been conducted so far to generate cavitation (cavitation phenomenon) in a fluid passing through a tube.

There are various cavitation generating means and, among them, means of using a guide vane formed by crossing aslant chordal edges of a pair of semi-elliptic blade disks and closing the chordal edges upstream of a crossing point by a triangular partition plate that bisects a transversal plane of the tube and securing the arcuate edges of a semi-elliptic blade disks to the inner wall of the tube to form a flow deflecting channel in the tube in a state of directing the partitioning edge of the partition plate of the guide vane to the upstream is disclosed in the specification and FIG. 3 to FIG. 4 of U.S. Pat. No. 5,474,749.

In the cavitation generating device described above, the fluid is accelerated by the crossing pair of the slanted blade disks while being rectified into two branched flows by the partition plate in the process where the fluid passes through the guide vane in the tube thereby being defected into swirling flows applied with a large centrifugal acceleration to generate cavitation to the fluid downstream of the guide vane. However, since the fluid passage of the flow deflecting channel has a large open area formed by the chordal edge downstream of the crossing point of one semi-elliptic blade disk and the chordal edge upstream of the crossing point of the other semi-elliptic blade disks, acceleration of the fluid undergoes inevitable limit.

Accordingly a first object of the present invention is to further improve the cavitation generating device described above and provide a device for generating cavitation at higher negative pressure by promoting acceleration of a fluid.

A second object of the present invention is to provide a liquid mixing device of a higher mixing efficiency by utilizing the cavitation generating device described above.

DISCLOSURE OF THE INVENTION

For attaining the foregoing first object, the present invention provides a cavitation generating device comprising a tube for feeding a fluid under pressure; and a guide vane in which chordal edges of a pair of semi-elliptic blade disks are crossed aslant, a space between chordal edges upstream of the crossing point is closed with a partition plate that bisects a transversal plane of the tube and arcuate edges of the pair of semi-elliptic blade disks are secured to the inner wall of the tube, wherein a fluid channel between the chordal edge downstream of the crossing point of one semi-elliptic blade disk and the chordal side edge upstream of the crossing point of the other semi-elliptic blade disk of the guide vane is partially closed by a restriction means such as a baffle plate. With a constitution described above, centrifugal acceleration is increased for the spiral fluid passing the guide vane in the tube by the restriction means for the fluid channel, to thereby generate cavitation of a higher negative pressure downstream of the guide vane of the tube.

Further, for attaining the second object, the fluid mixing device according to the present invention comprises a tube for feeding a fluid under pressure; a guide vane in which chordal edges of a pair of semi-elliptic blade disks are closed aslant, a space between the chordal edges upstream of the crossing point is crossed with a partition plate that bisects a transversal plane of the tube, a fluid channel between the chordal edge downstream of the crossing point of one semi-elliptic blade disk and the chordal edge upstream of the crossing point of the other semi-elliptic blade disk is partially crossed by a restriction means such as a baffle plate and the arcuate side edges of the pair of semi-elliptic blade disks are secured to the inner wall of the tube; and a plurality of protrusion protruded radially from the inner circumferential wall surface downstream of the tube of the guide vane.

This constitution can remarkably promote mixing-stirring of a fluid, and can provide extremely high effect for various types of reaction and processings.

By shaping the protrusion downstream of the guide vane as a tapered protrusion of a convexly curved configuration, fibrous objects, if mixed in the fluid, do not cause entanglement to facilitate maintenance.

Further, the restriction means for the fluid channel of the guide vane may be preferably a plate integrated with the partition plate that bisects the transversal plane of the tube, or it may has a constitution that the chordal edges downstream of the crossing point of the semi-elliptic blade disk are bent or curved partially or entirely toward the restricted flow channel.

BEST MODE FOR PRACTICING THE INVENTION

Embodiments of the present invention are to be described more in details with reference to the accompanying drawings.

Figure 1:
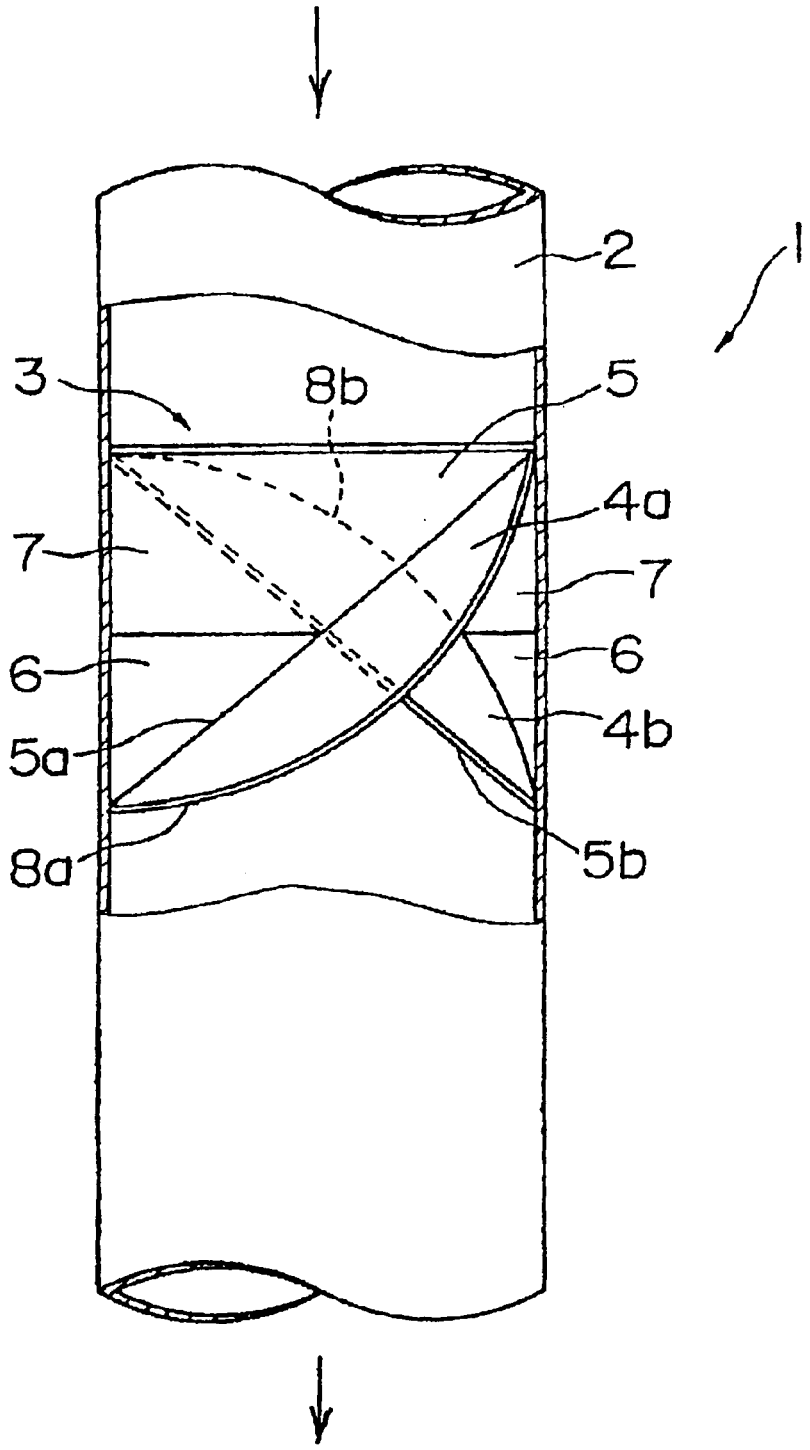
FIG. 1 is a partially cut-away perspective view showing a schematic constitution of a preferred cavitation generating device according to the present invention.

As shown in FIG. 1, a cavitation generating device 1 according to the present invention comprises a tube 2 for feeding a fluid under pressure comprising gas, liquid, fluidized solid or a mixture thereof in the direction of an arrow and a guide vane 3 disposed in the tube 2.

The guide vane 3 has a constitution in which chordal edges 5*a*, 5*b* of a pair of semi-elliptic blade disks 4*a*, 4*b* are crossed aslant, a space between the chordal edges upstream of the crossing point is closed by a partition plate 5 that bisects a transversal plane of the tube 2 and a region defined by the chordal edge downstream of the crossing point of one semi-elliptic blade disk 4*a* and the chordal edge of the crossing point of the other semi-elliptic blade disk 4*b*, that is, a fluid channel 6 is partially closed by a restriction means 7 such as a baffle plate, and is disposed by securing arcuate edges 8*a*, 8*b* of the pair of semi-elliptic blades 4*a*, 4*b* to the inner wall of the tube 2.

The cavitation generating device 1 according to the present invention provides a fluid passing through the guide vane 3 with a greater centrifugal acceleration by the provision of the additional restriction means 7 to the guide vane 3 thereby generating cavitation (cavitation phenomenon) of a higher negative pressure in the tube downstream of the guide vane 3.

The restriction means 7 of the embodiment in FIG. 1 comprises a portion of a rectangular plate integrated with the partition plate 5, and the fluid channel 6 is restricted by closing the space between the chordal edge downstream of the crossing point of one semi-elliptic blade disk and the chordal edge upstream of the crossing point of the other semi-elliptic blade disk with the restriction means 7 forming a portion of the rectangular plate.

Figure 2:
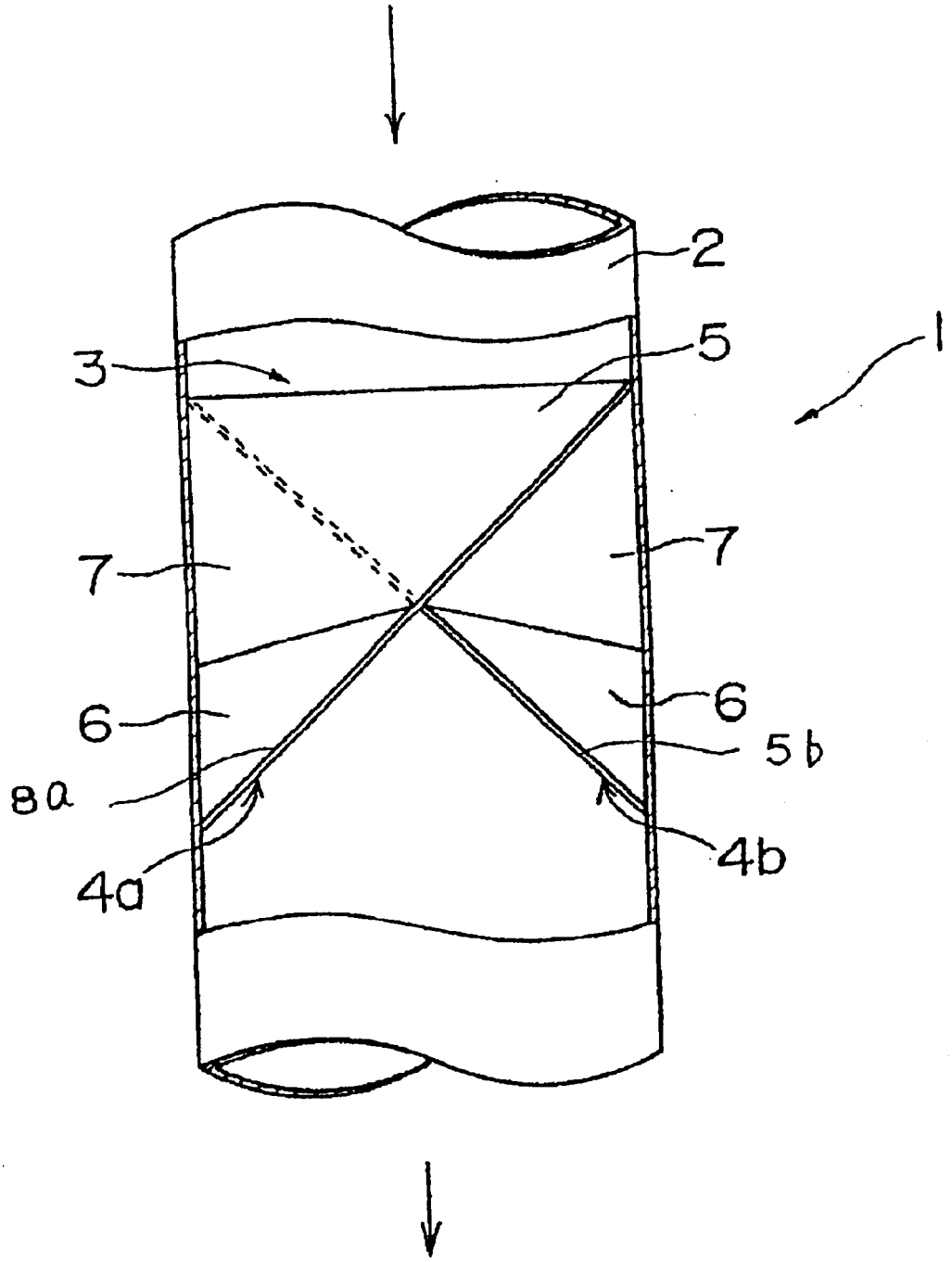
FIG. 2 to FIG. 7 a partially cut-away perspective view showing a schematic constitution of a cavitation generating device using a restriction means of another embodiment.
Figure 3:
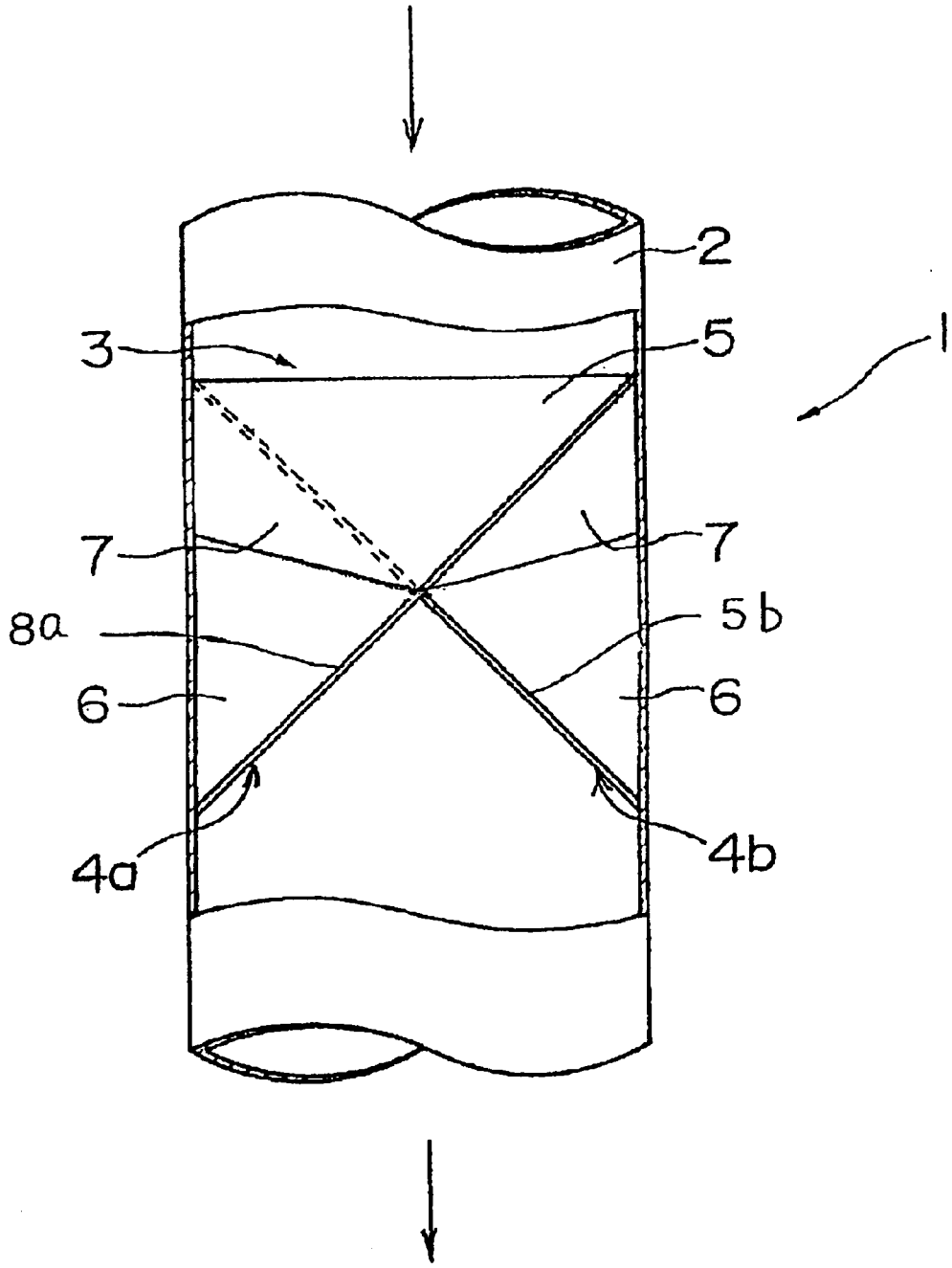

The embodiment of forming the restriction means 7 with the plate integrated with the partition plate 5 is not restricted to a case of forming the partition plate 5 into the rectangular form as shown in FIG. 1 but it may be formed, as shown in FIG. 2 and FIG. 3, into a polygonal shape with an increased closing area (refer to FIG. 2). or a polygonal shape with a decreased closing area (refer to FIG. 3).

Figure 4:
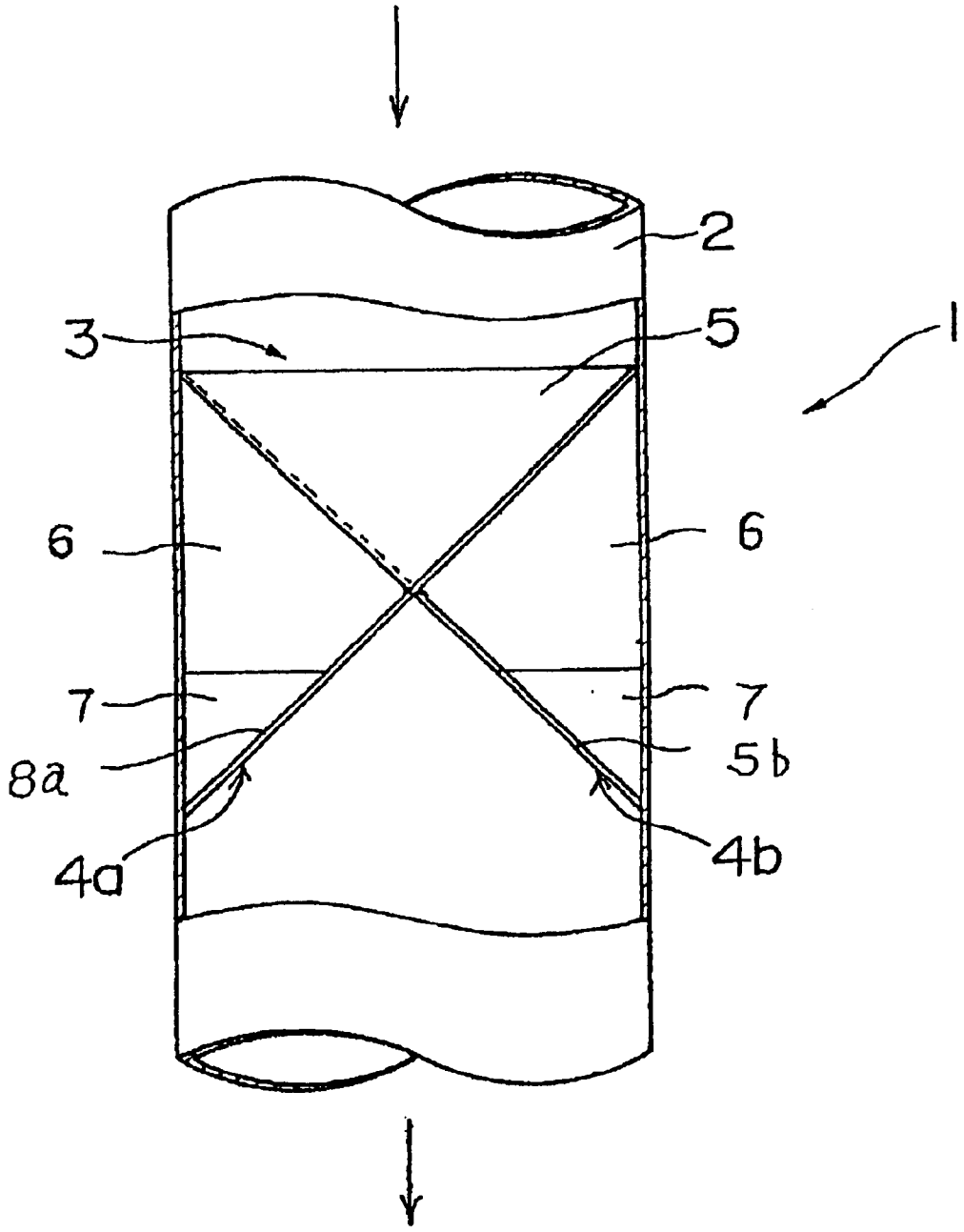
Figure 5:
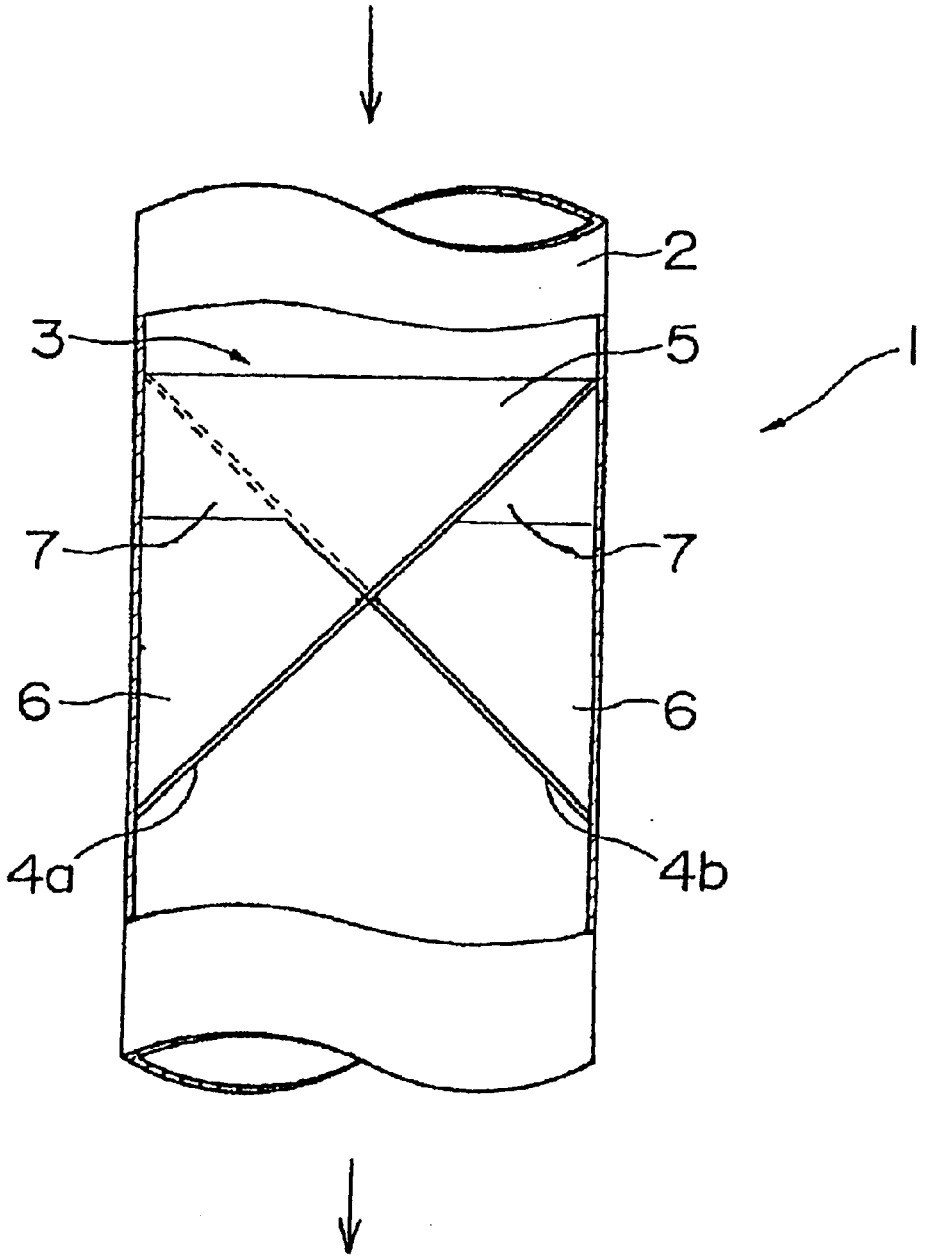
Figure 6:
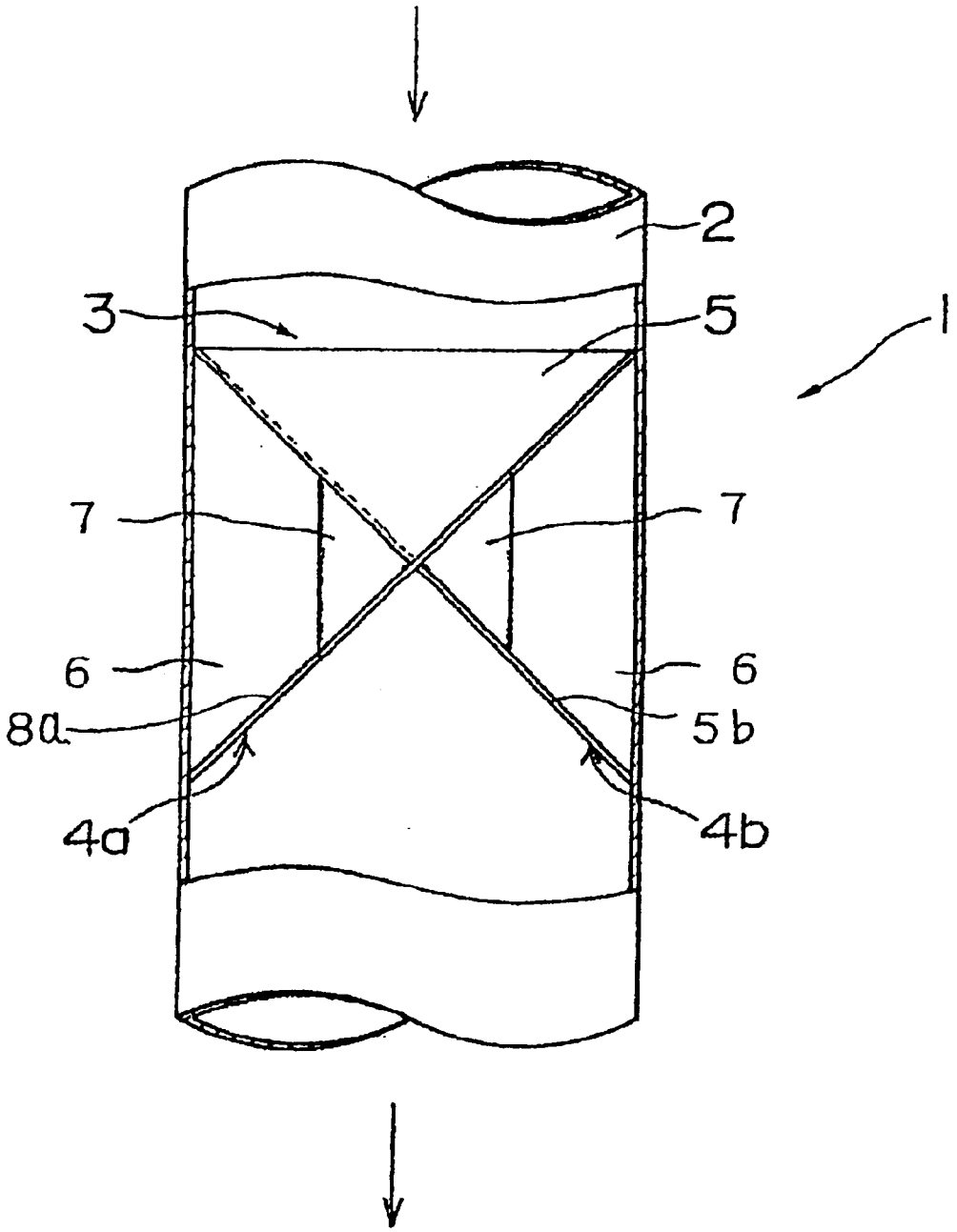

Further, the restriction means may be disposed locally at the corner of the fluid channel 6 as shown in FIG. 4, FIG. 5 and FIG. 6.

Figure 7:
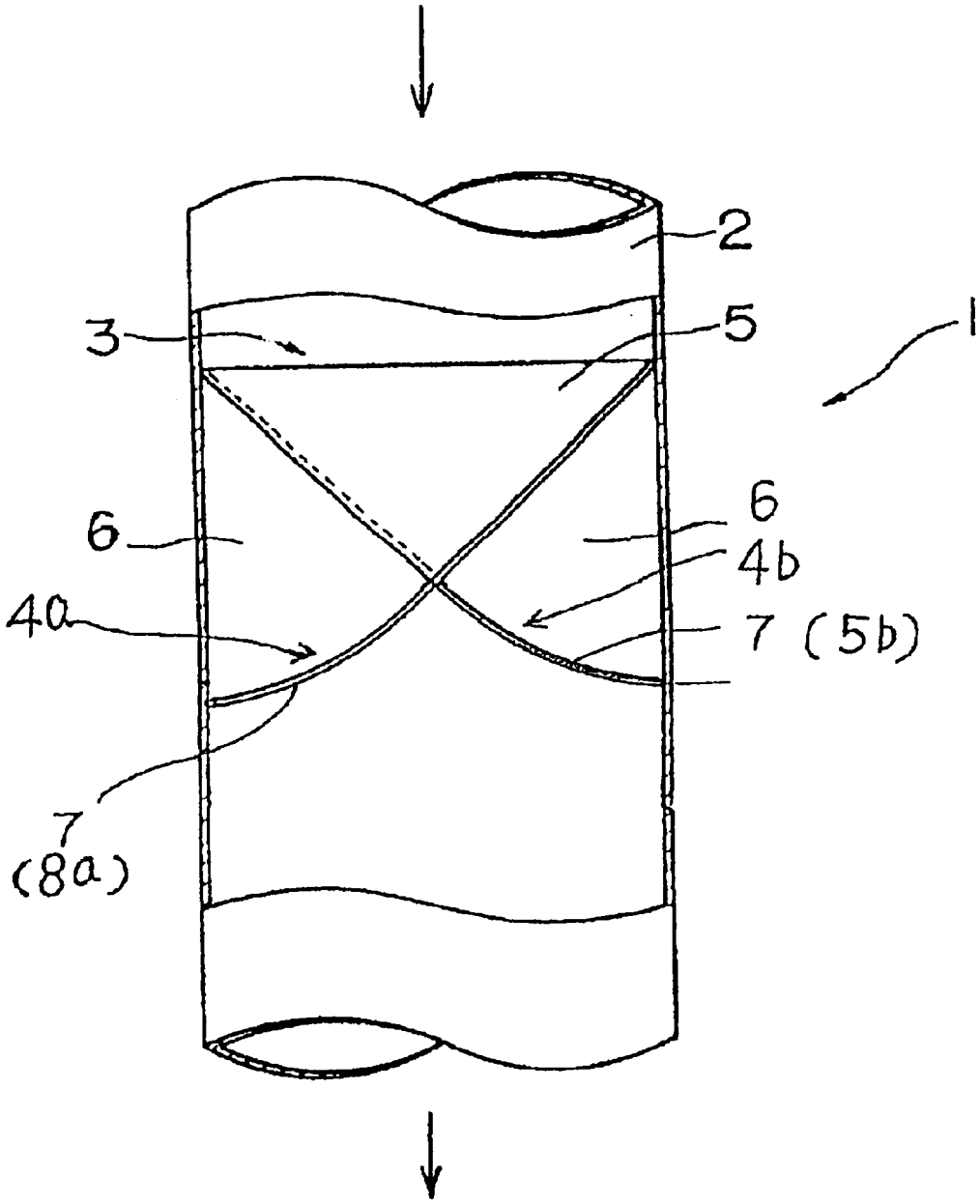

Further, the restriction means 7 of the guide vane 3 according to the present invention may be constituted, as shown in FIG. 7, such that the semi-elliptic blade disks 4*a*, 4*b* are bent or curved toward the upstream entirely or partially (particularly, downstream of the crossing point) to restrict the fluid channel 6 between the chordal edge downstream of the crossing point of one blade disk and the chordal edge upstream of the crossing point of the other blade disk.

Then, the operation of the cavitation generating device according to the present invention is to be described.

A fluid fed under pressure in the tube 2 along the direction of an arrow (for example, a mixed fluid of air and water) is divided into two branched flows by the partition plate 5 and then induced along the two sheets of the semi-elliptic blade disks 4*a*, 4*b* under rectification thereby been deflected into swirling flows with intense twisting. In this case, large shearing stresses are generated in the fluid by abrupt separating and flow deflection by the partition plate 5 and the blade disks 4*a*, 4*b* and the fluid is mixed as turbulent flows of fine liquid particles and fine air bubbles.

Further, since the fluid is restricted compared with the transversal area of the tube 2 by the flow deflecting channel defined with the partition plate 5, the pair of semi-elliptic blade disks 4*a*, 4*b* and the inner wall of the tube 2, it is accelerated to generate a negative pressure in proportion with the square of the fluid circumferential velocity in an enlarged region downstream of the guide vane 3. According to the present invention, since the fluid channel 6 is further restricted by the restriction means 7, the circumferential velocity of the fluid passing the guide vane 3 is further increased to form a pressure increased portion on the inner circumferential wall in the tube 2 in a flow channel enlarged region downstream of the guide vane 3 to generate cavitation at a higher negative pressure in a axial central portion.

Accordingly, the mixed gas/liquid fluid at a positive pressure fed under pressure in the tube 2 undergoes extremely violent stirring/mixing actions in the negative pressure region downstream the guide vane to exhibit an extraordinarily disturbed state.

Figure 8:
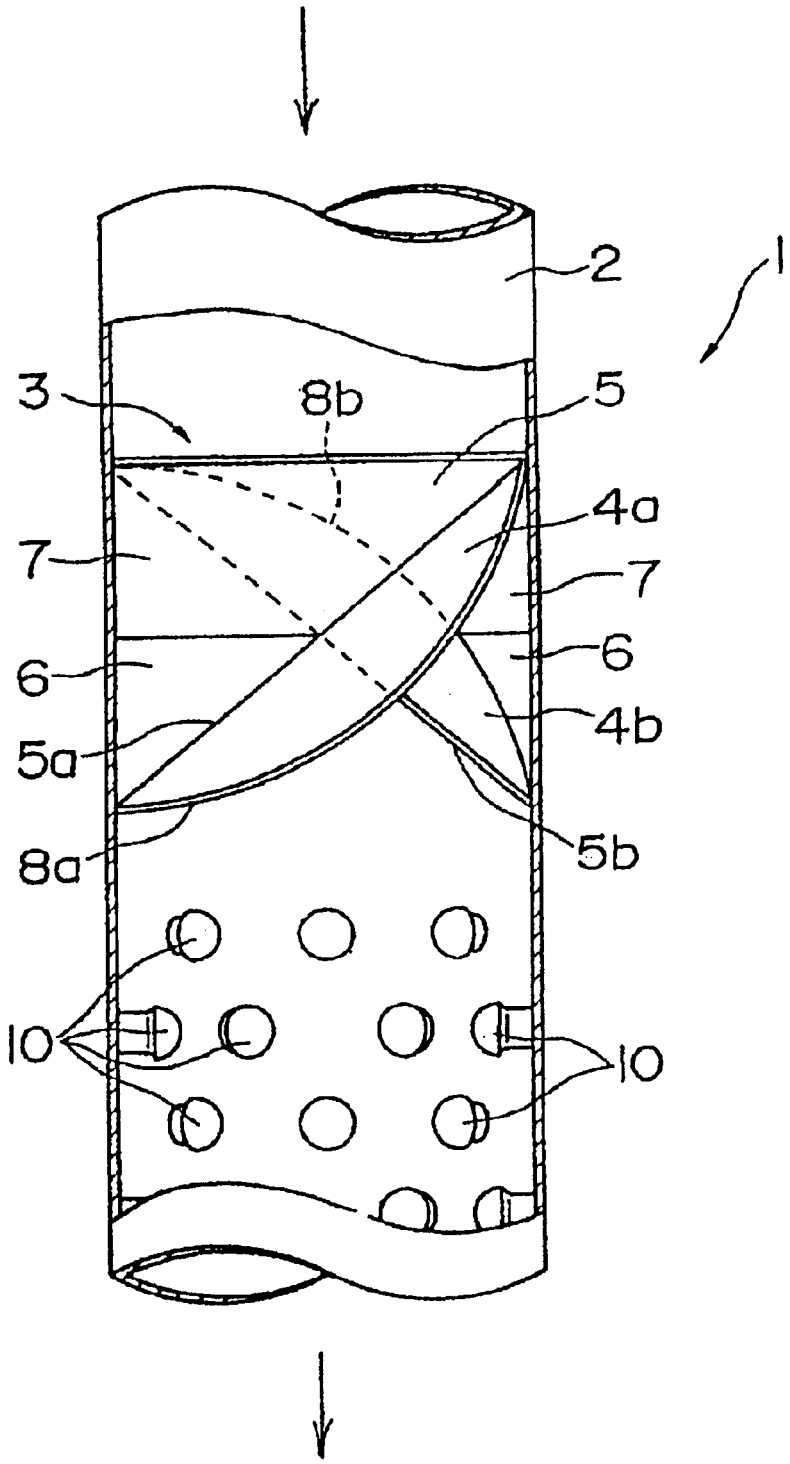
FIG. 8 is a partial cut-away perspective view showing a schematic constitution of a preferred fluid mixing device using the cavitation generation device according to the present invention.

Then, FIG. 8 shows a fluid mixing device using the cavitation generating device 1 described above. In the fluid mixing device 9, a guide vane 3 provided with the restriction means 7 described above is disposed in a tube 2, a plurality of protrusions 10 are secured radially to the inner circumferential wall of the tube downstream of the guide vane 3, and the swirling flows of the fluid provided with the large centrifugal acceleration as described above collide against the protrusions 10, to thereby form violent mixing and stirring actions as described below.

In a case where the fluid fed under pressure in the tube 2 is, for example, a fluid mixture of a gas (air) and a liquid, swirling flows passing through the guide vane 3 and provided with large centrifugal acceleration form a liquid layer with the transfer of the fluid as a larger mass component toward the flowing bed and transfer of the gas as a smaller mass component toward the inside of the liquid layer to form a gas layer at the boundary thereof in adjacent with the liquid layer and swirl at a higher velocity than the liquid layer by the cavitation phenomenon described above.

Accordingly, fine liquid particles and fine air bubbles collide violently in the process of forming the liquid layer and the gas layer and a violent turbulent vortexes are generated at the boundary between the liquid layer and the gas layer by intense fluid friction.

The protrusions 10 are attached with each head 11 being directed to the axial center of the tube 2 and with the head 11 being higher than the height of the liquid layer relative to the swirling flows.

The liquid layer of the swirling flows ascends as far as the head of the protrusion 10 while intaking the kinetic energy of the gas layer at a higher velocity than the liquid layer and forms a liquid membrane on the surface of the head of the protrusion 10. The liquid membrane is peeled by the gas layer at a higher velocity than that of the liquid layer, converted into a great amount of fine particles and scattered radially into the gas layer at the downstream to cause gas/liquid mixing.

Further, the scattered fine particles of the liquid during the gas/liquid mixing move toward the initial liquid layer under the effect of large centrifugal force of the swirling flows and, while on the other hand, a great amount of fine air bubbles float in the liquid of the swirling flows passing through the guide vane 3 and they move apart from the liquid layer to the inside of the tube 2 to generate centripetal force of the gas bubbles.

Thus, the fluid undergoes violent gas/liquid mixing by gas/liquid mixing caused by shear stresses upon passage through the guide vane 3 and gas/liquid mixing stirring upon collision against the protrusion 10, as well as continuous collision between the fine liquid particle group moving outward by the centrifugal force and fine air bubble group moving inward by the centripetal force, thereby attaining a high speed gas/liquid reaction.

Figure 9:
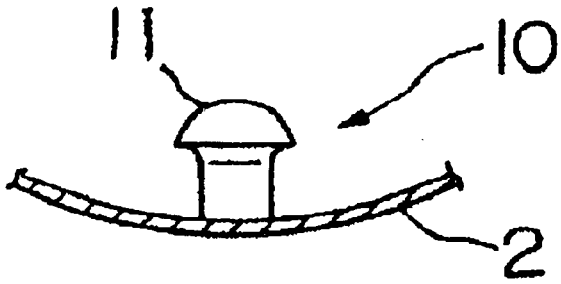
FIG. 9 to FIG. 11 are views for embodiments of protrusions.
Figure 10:
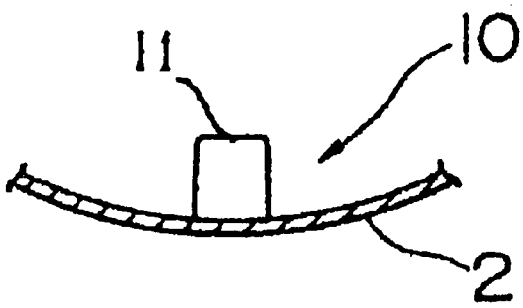

As the protrusion 10, a protrusion having a semi-spherical head and a frust conical neck as shown in FIG. 9, a simply cylindrical column as shown in FIG. 10, as well as of any other shape may be used.

Figure 11:
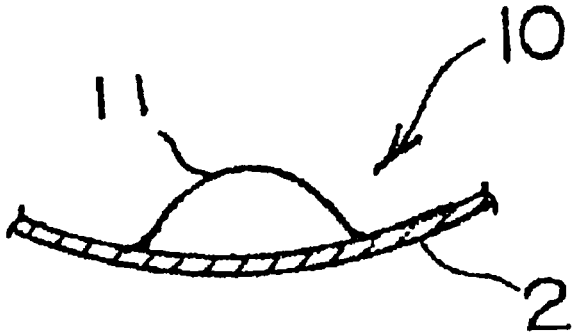

The fluid mixing device according to the present invention is used for exposure to air, neutralization, emulsification, as well as various types of mixing, stirring and reactions. In a case of use for the treatment of a fluid incorporated with fibrous materials, since the fibrous materials tend to cause entanglement around the protrusion 10, it is desirable to form the same into a convex protrusion with a curved surface as shown in FIG. 11 such that the fibrous materials less tend to entangle or they easily detached along the flows even when they cause entanglement.

In the example shown in the drawing, while the partition plate 5 for the guide vane is disposed being directed upward but it is not restrictive but it can be used in any form such as being directed downward or laterally depending on the purpose of the use.

For example, when the device according to the present invention is used for exposure to air, it is placed in water such that the partition site of the partition plate 5 is downwarded (in the direction opposite to FIG. 8) and air is fed from below the guide vane. Further, when it is used for a reaction device, it may be used being disposed horizontally or vertically in the midway of the fluid feed tube for the processed fluid.

Industrial Applicability as described above, since the cavitation generating device and the fluid mixing device using the cavitation generating device according to the present invention can generate the cavitation phenomenon at a higher negative pressure downward of the guide vane, thereby obtaining violent stirring/mixing actions, it can be utilized generally, for example, to reaction promotion for various kinds of fluids, aeration, exposure to air, deaeration, and activation—purification treatment.

What is claimed is:

1. A cavitation generating device comprising a tube for feeding a fluid under pressure; and a guide vane in which chordal edges of a pair of semi-elliptic blade disks are crossed aslant, a space between the chordal edges upstream of the crossing point is closed by a partition plate that bisects a transversal plain of the tube, and arcuate edges of the pair of semi-elliptic blade disks are secured to the inner wall of the tube, wherein a fluid channel between the chordal edge downstream of the cross point of one semi-elliptic blade disks and the chordal edge upstream of the crossing point of the other semi-elliptic blade disk of the guide vane is partially closed by a restriction means comprising a plate integrated with the partition plate.

2. A fluid mixing device comprising a tube for feeding a fluid under pressure; a guide vane in which chordal edges of a pair of semi-elliptic blade disks are crossed aslant, a space between the chordal edges upstream of the crossing point is closed by a partition plate that bisects a transversal plane of the tube, a fluid channel between the chordal edge downstream of the crossing point of one semi-elliptic blade disk and the chordal edge upstream of the crossing point of the other semi-elliptic blade disk is partially closed by a restriction means comprising a plate integrated with the partition plate and arcuate edges of the pair of semi-elliptic blade disks are secured to the inner wall of the tube; and a plurality of protrusions protruded radially from the inner circumferential wall surface of the guide vane downstream of the tube.

3. A fluid mixing device according to claim 2, wherein the protrusion is a convex protrusion formed with a curved surface.

* * * * *